US009168662B1

(12) United States Patent
Brown

(10) Patent No.: US 9,168,662 B1
(45) Date of Patent: Oct. 27, 2015

(54) LIGHTED RAZOR

(71) Applicant: Kevin Brown, Greenville, NC (US)

(72) Inventor: Kevin Brown, Greenville, NC (US)

( * ) Notice: Subject to any disclaimer, the term of this patent is extended or adjusted under 35 U.S.C. 154(b) by 209 days.

(21) Appl. No.: 13/692,624

(22) Filed: Dec. 3, 2012

(51) Int. Cl.

| | |
|---|---|
| ***B26B 19/00*** | (2006.01) |
| ***B26B 21/00*** | (2006.01) |
| ***B26B 19/46*** | (2006.01) |
| ***B26B 21/46*** | (2006.01) |

(52) U.S. Cl.
CPC ..... *B26B 21/46* (2013.01)

(58) Field of Classification Search
CPC ..... B26B 21/46
USPC ..... 30/526, 537, 32, 34.05; 362/115
See application file for complete search history.

(56) References Cited

U.S. PATENT DOCUMENTS

| | | | | | |
|---|---|---|---|---|---|
| 1,180,686 | A | | 4/1916 | Allport | |
| 1,223,305 | A | | 4/1917 | Allport | |
| 1,258,058 | A | * | 3/1918 | Stuefer | 362/115 |
| 1,429,760 | A | | 9/1922 | Norquist | |
| 1,862,274 | A | * | 6/1932 | Mendelsohn | 362/115 |
| 1,900,965 | A | | 3/1933 | Weiss | |
| 1,950,789 | A | * | 3/1934 | Eells | 362/115 |
| 2,309,035 | A | * | 1/1943 | Beam | 362/115 |
| 2,530,069 | A | | 11/1950 | Moore | |
| 3,121,286 | A | * | 2/1964 | Schneiderman | 30/34.05 |
| 4,028,540 | A | * | 6/1977 | Key et al. | 362/118 |
| 4,094,062 | A | * | 6/1978 | Papanikolaou | 30/34.05 |
| 4,473,943 | A | * | 10/1984 | Papanikolaou | 30/34.05 |
| 5,299,104 | A | * | 3/1994 | Parmentier | 362/115 |
| 5,528,477 | A | * | 6/1996 | Carmo | 362/260 |
| 5,582,476 | A | * | 12/1996 | Hansen | 362/115 |
| 6,227,676 | B1 | * | 5/2001 | Sneddon | 362/115 |
| 6,280,051 | B1 | | 8/2001 | Wallach | |
| 6,406,157 | B1 | * | 6/2002 | Audet | 362/115 |
| 6,478,442 | B2 | * | 11/2002 | Chen | 362/119 |
| 6,915,576 | B2 | * | 7/2005 | Brzezinski | 30/34.05 |
| 7,473,007 | B1 | * | 1/2009 | Wang | 362/187 |
| 7,510,296 | B2 | * | 3/2009 | Nevin | 362/119 |
| 7,581,846 | B2 | * | 9/2009 | Hayman et al. | 362/119 |
| 7,652,436 | B2 | | 1/2010 | Dowling et al. | |
| 7,739,797 | B2 | * | 6/2010 | Rawle | 30/34.1 |
| 8,061,041 | B2 | * | 11/2011 | Jessemey et al. | 30/45 |
| 8,065,802 | B2 | * | 11/2011 | Oglesby et al. | 30/50 |
| 8,089,227 | B2 | * | 1/2012 | Baertschi et al. | 318/119 |
| 8,118,444 | B2 | * | 2/2012 | Nevin | 362/119 |
| 2007/0107229 | A1 | * | 5/2007 | Ribal | 30/34.05 |
| 2008/0134511 | A1 | * | 6/2008 | Salvatore | 30/32 |

FOREIGN PATENT DOCUMENTS

| | | | |
|---|---|---|---|
| GB | 421345 | A | 12/1934 |
| GB | 2430906 | A | 4/2007 |

* cited by examiner

*Primary Examiner* — Ghassem Alie
*Assistant Examiner* — Bharat C Patel
(74) *Attorney, Agent, or Firm* — Coats & Bennett, P.L.L.C.

(57) ABSTRACT

A lighted razor that directs light in one or more different directions. The directed light enables a user to shave when in dark environments, and to adjust the amount of light that emanates from the razor. The lighted razor generally includes a body with a blade for shaving. A light is attached to the body, and may be powered and controlled by mechanisms in the body. A sleeve is adjustably positioned over the light to adjust an amount of light emanating from the razor.

12 Claims, 9 Drawing Sheets

LIGHTED RAZOR

FIELD OF THE INVENTION

The present application is directed to a razor and, more particularly, to a razor with a light that directs light to the cutting blade and/or the area of the person being shaved.

BACKGROUND

Razors are used in many instances in which the amount of available light is minimal or non-existent. Examples include but are not limited to shaving in a bathroom early in the morning when it is still dark, and shaving in an outdoor environment such as during a camping trip. During these instances, better and/or more light on the shaving surface or the razor's blade would facilitate the shaving process.

However, simply providing a user with an additional light is not practical. It would be difficult for a person shaving to hold a razor with one hand and a light in a second hand. This may be dangerous or not effective as often two hands are needed during the shaving process to hold the razor and to also hold or position the skin of the area being shaved.

Additional light may also be problematic in waking another person that is sleeping in an adjacent area. The light may provide benefit to the shaving person, but also cause the adjacent sleeper to be awakened which is often problematic. This may occur in a hotel room or bedroom in which the bathroom is adjacent to a bed with no intermediate divider that would block the light.

Further, additional light may actually make shaving more difficult for a person. The additional light may shine into the user's eyes making it difficult for the user to observer the razor blade and/or shaving area.

Therefore, there is a need for a lighted razor to provide light to facilitate the shaving process without providing an over-abundance of light that may be problematic.

SUMMARY

The present application is directed to a razor with a light for use in darkened environments. The amount of light being emitted may be adjusted to suit the needs of the user.

One embodiment of a razor includes a body with a handle and a blade, with the handle having an elongated shape with a longitudinal axis. At least one light element that emits light is associated with the handle. The light element is configured to emit the light in an axial direction along the longitudinal axis and a lateral direction perpendicular to the longitudinal axis. A housing extends over the one or more light elements and includes a lateral wall with a light emitting portion that extends along a first portion of the lateral wall with a remainder of the lateral wall being opaque. A sleeve with an opaque portion is operatively connected to the housing. The sleeve is positionable between a first orientation with the opaque portion positioned across the light emitting portion of the lateral wall to prevent the light from being emitted in the lateral direction, and a second orientation with the opaque portion away from the light emitting portion for the light to be emitted laterally.

The one or more light elements and the housing may be positioned axially along the longitudinal axis between the handle and the blade with the light emitted in the axial direction shining on the blade. A neck may extend between and connect the handle and the blade with the housing further including an opening through which the neck extends. The housing may include a translucent axial wall. The lateral wall of the housing may be continuous and the light emitting portion may include a translucent material. The light emitting portion may have a length that is less than or equal to one half of a total length of the housing. The housing and the sleeve may each have a circular cross-sectional shape for the sleeve to rotate around the housing. The sleeve may include an opening formed between opposing ends with the opening positioned away from the light emitting portion of the lateral wall in the first orientation and at the light emitting portion in the second orientation.

Another embodiment includes a razor having a body with a handle and a blade. The blade faces in a first lateral direction. A housing is positioned at and end of the handle. The housing includes a lateral wall with a light emitting portion that faces in the first lateral direction and an opaque portion that faces in an opposing second lateral direction. At least one light element is positioned in the housing and configured to emit light in the first lateral direction. A sleeve is positioned at the housing and includes an opaque portion. The sleeve is movable relative to the housing between a first orientation with the opaque portion positioned across the light emitting portion of the lateral wall to prevent the light from being emitted beyond the sleeve in the first lateral direction, and a second orientation with the opaque portion away from the light emitting portion of the lateral wall for the light to be emitted in the first lateral direction.

The housing may also include a translucent wall positioned at an axial end of the housing. The translucent wall and the lateral wall may include a one-piece unitary construction with the translucent wall and the light emitting portion each being constructed from a translucent material. The opaque portion of the lateral wall may extend at least one-half of a length of the lateral wall. Each of the housing and the sleeve may include a substantially circular cross-sectional shape for the sleeve to rotate around the housing. The sleeve may include a C-shaped body with a gap positioned between opposing ends. The housing may provide for light to be emitting beyond the housing in an axial direction when the sleeve is in both the first and second orientations.

Another embodiment of the razor includes a body with an elongated handle and a blade positioned at an end of the handle with the blade facing in a first lateral direction. A housing is positioned between the end of the handle and the blade. The housing includes a lateral wall and a translucent axial wall that form an interior space that is positioned at the end of the handle. The lateral wall includes a translucent portion that faces in the first lateral direction and an opaque portion that faces in an opposing second lateral direction. At least one light element is positioned in the interior space and is configured to produce light that is emitted through the translucent axial wall and the translucent portion of the lateral wall. A sleeve is positioned over the lateral wall of the housing and includes an opaque portion and a light emitting portion. The sleeve is movable relative to the housing between a first orientation with the opaque portion positioned across the translucent portion of the lateral wall to prevent the light from being emitted beyond the sleeve in the first lateral direction, and a second orientation with the light emitting portion of the sleeve positioned at the translucent portion of the lateral wall for the light to be emitted beyond the sleeve in the first lateral direction.

The light emitting portion of the sleeve may include a gap formed between opposing ends of the opaque portion. The sleeve may be configured to allow the light to be emitted through the translucent axial wall of the housing in both the first and second orientations. A part of the opaque portion of the sleeve may be positioned across the translucent portion of the lateral wall in the second orientation. The translucent portion may comprise less than or equal to one-half of the total length of the lateral wall. The body may further include a neck that extends between and connects the handle and the head, the neck extends through the translucent axial wall of the housing.

The various aspects of the various embodiments may be used alone or in any combination, as is desired.

DETAILED DESCRIPTION

The present application is directed to a lighted razor that directs light in one or more different directions. The directed light enables a user to shave when in dark environments, and to adjust the amount of light that emanates from the razor. The lighted razor generally includes a body with a blade for shaving. A light is attached to the body, and may be powered and controlled by mechanisms in the body. A sleeve is adjustably positioned over the light to adjust an amount of light emanating from the razor.

Figure 1:
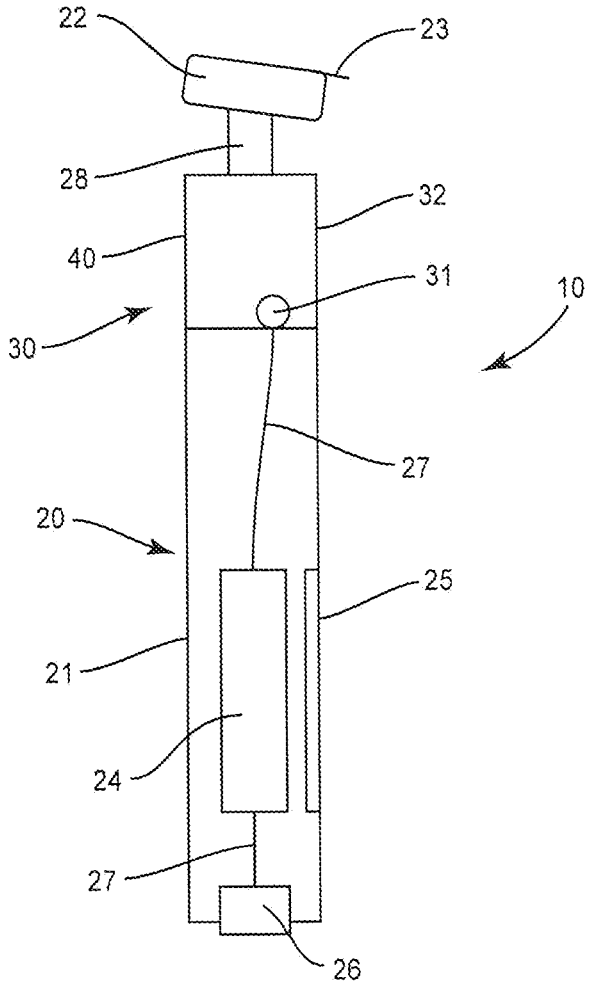
FIG. 1 is a schematic diagram of a lighted razor.

FIG. 1 schematically illustrates a lighted razor 10. The razor 10 includes a body 20, a light 30, and a sleeve 40. The body 20 includes a handle 21 that is grasped by the user during the shaving process. The body 20 also includes a head 22 with a blade 23 for shaving the user. The light 30 is attached to the body 20 and includes at least one light element 31 that emits light and a housing 32 that extends around at least a portion of the element 31. The sleeve 40 is adjustably positioned over the light 30 to adjust an amount of emitted light.

Figure 2:
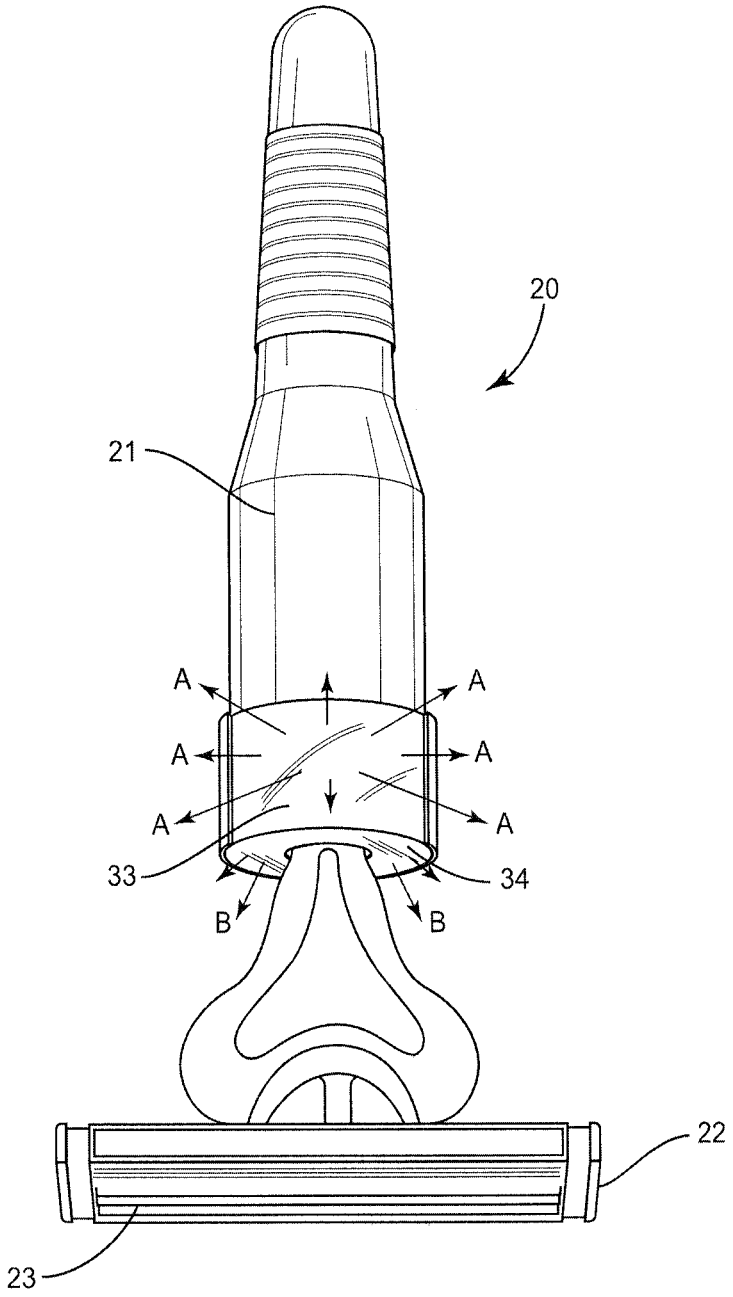
FIG. 2 is a perspective view of a lighted razor in an open orientation.
Figure 3:
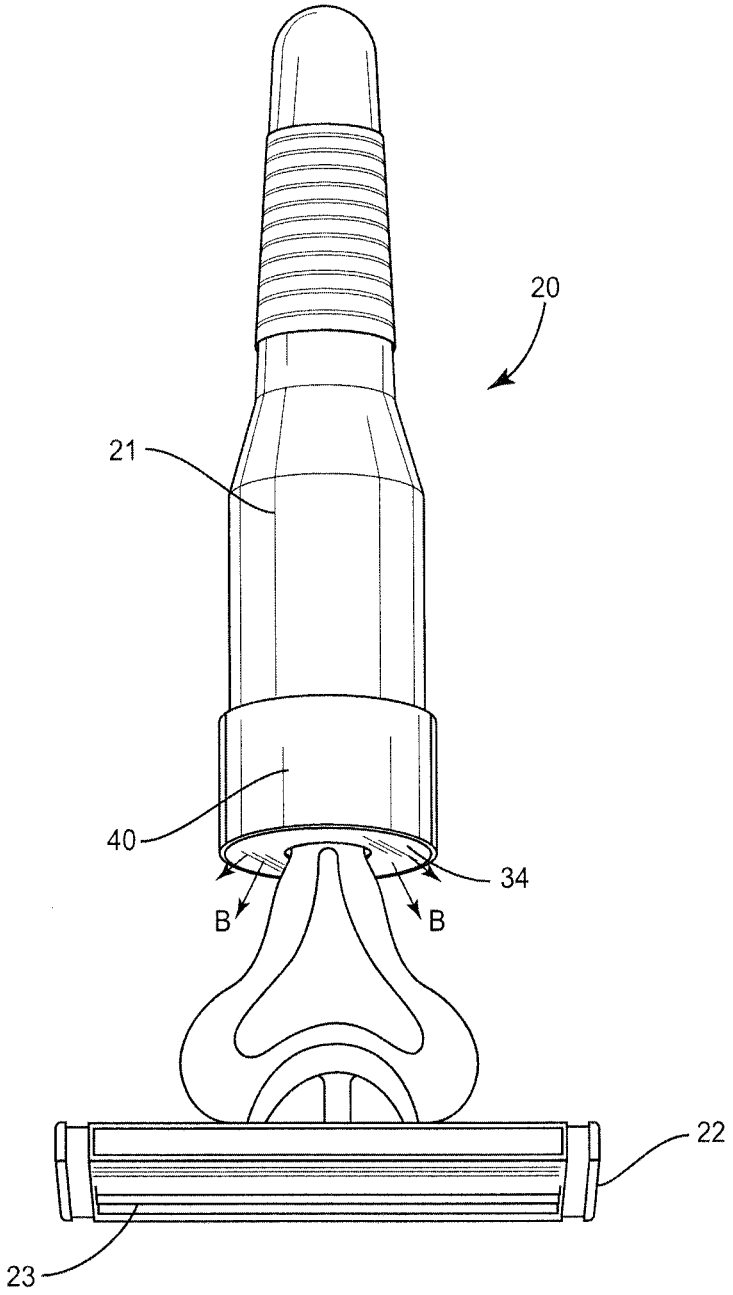
FIG. 3 is a perspective view of a lighted razor in a closed orientation.

The razor 10 is adjustable between an open orientation that laterally emits light in the direction indicated by arrows A as illustrated in FIG. 2, and a closed orientation that does not laterally emit light as illustrated in FIG. 3. The laterally-emitted light shines in the direction of the head 22 such that light is directed towards the portion of the user's body that is being shaved. The razor 10 is further configured to emit light in an axial direction in both the open and closed orientations as illustrated by arrows B in FIGS. 2 and 3.

The body 20 includes the handle 21 and head 22. The handle 21 is sized to be grasped by the user during the shaving process. The handle 21 may include various shapes and sizes to facilitate this use. In one embodiment, the handle 21 is substantially cylindrical with a round cross-sectional shape. The handle 21 may also include an exterior surface to facilitate gripping by the user. The exterior surface may include a rubber coating, a knurled surface, or a series of ribs that extend along the length.

The handle 21 forms an outer shell with an enclosed interior for holding a battery 24. The handle 21 may further include one or more removable sections 25 that provide access to the interior, such as for removing and/or replacing the battery 24.

The body 20 also includes a head 22 with one or more blades 23. The head 22 is positioned at an axial end of the body 20 and on an opposite side of the light 30 from the handle 21. This positioning provides for light emitted in the axial direction to illuminate the head 22.

A neck 28 may extend between and connect the head 22 and the handle 21. The neck 28 may include various lengths to position the head 22 at various locations outward from the light 30. The neck 28 may be substantially straight such that the head 22 is axially aligned with the handle 21. The neck 28 may also include a curved or angular shape such that the head 22 is laterally offset to some extent from the handle 21. As illustrated in FIGS. 1, 2, and 3, the neck 28 may extend through the light 30.

One or more batteries 24 may be used for powering the light 30. The razor 10 may include a single battery 24, or may include multiple batteries 24. In the multiple battery 24 embodiments, the batteries 24 may be the same or may be different. Various types and sizes of batteries 24 may be used with the razor 10 to power the light 30. The batteries 24 may include alkaline batteries, and rechargeable battery packs with a variety of chemistries, such as but not limited to lithium-ion, lithium ion polymer, nickel metal hydride, and nickel cadmium. The rechargeable battery packs may be recharged while positioned in the handle 21, or may require removal prior to being recharged.

A switch 26 is positioned on the handle 21 for selectively powering the light 30. The switch 26 may include a depressible tab that is movable between a depressed "on" orientation, and an outward "off" orientation. The switch 26 may be positioned at various locations about the handle 21. FIG. 1 includes the switch 26 positioned at an axial end of the handle 21 opposite from the head 22. Electrical connections 27 extend between the battery 24 and the switch 26 and the battery 24 and the light 30.

The light 30 is positioned and configured to provide light during the shaving process. The light 30 includes one or more light elements 31 that are powered by the battery 24. The one or more light element 31 may be mounted on the axial end of the handle 21 and/or along the neck 28. FIG. 1 includes the elements 31 mounted to the axial end of the handle 21.

Various types of light elements 31 may be used for providing the light for the shaving process. Examples include but are not limited to incandescent bulbs, halogen bulbs, xenon bulbs, high intensity discharge lamps, and light emitting diodes (LED). In multiple-element embodiments, the elements may be the same or different types. Further, the different elements may be the same or different sizes.

Figure 4:
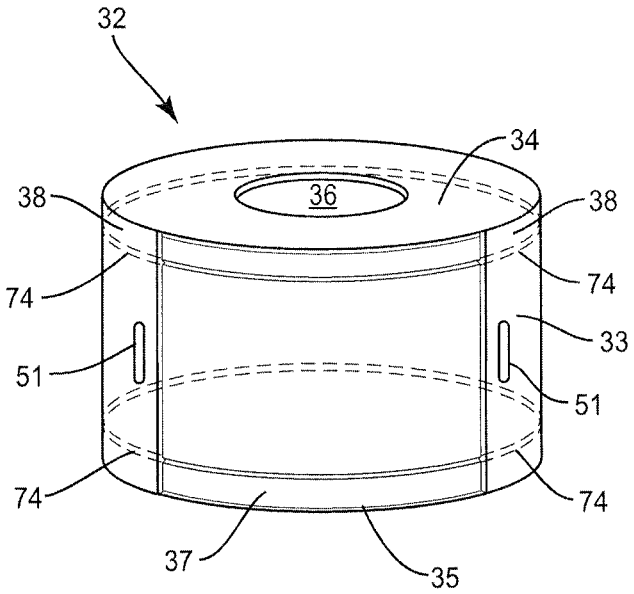
FIG. 4 is a perspective view of housing.

The light 30 also includes a housing 32 as illustrated in FIG. 4 that extends around the one or more elements 31. The housing 32 includes lateral wall 33 and an axial wall 33. An opposing axial end 35 is open and is configured to mount to the handle 21. The housing 32 may include various shapes and sizes, including a shape that substantially matches that of the handle 21. FIG. 4 includes a cylindrical shape with a diameter that substantially matches that of the handle 21. Other embodiments may include the housing 32 having larger or smaller widths, and the same or different cross-sectional shapes than the handle 21. An opening 36 in the axial wall 34 accommodates the neck 28.

Figure 5:
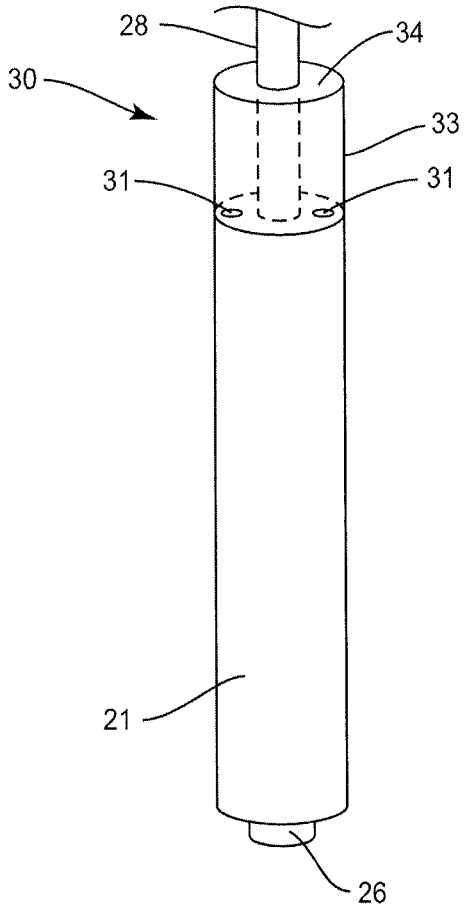
FIG. 5 is a perspective view of a housing mounted at an axial end of a handle with a neck extending through the housing.

FIG. 5 illustrates a housing 32 attached to an axial end of the handle 21. The housing 32 extends over the elements 31 that are mounted on the axial end of the handle 21. The size and shape of the housing 32 substantially matches that of the handle 21.

The lateral wall 33 includes a translucent section 37 and an opaque section 38. The translucent section 37 provides for the passage of light from the one or more elements 31 laterally outward beyond the housing 32. The translucent section 37 may be completely transparent, or may provide from some scattering of the light. The opaque section 38 prevents the passage of light from the one or more elements 31.

Figure 6:
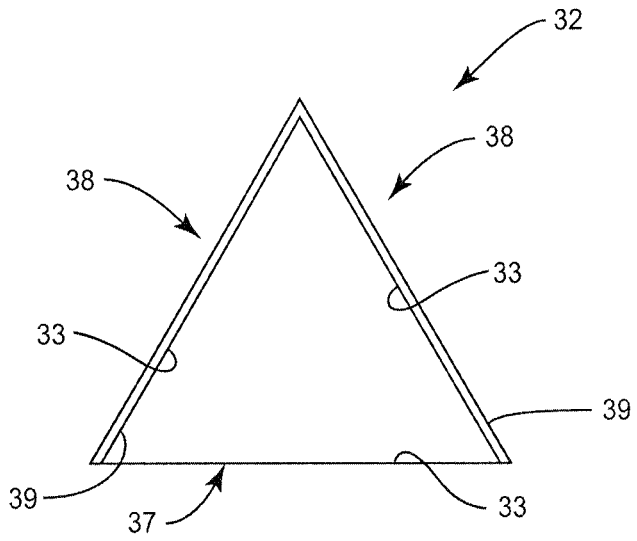
FIG. 6 is a schematic sectional view of housing with translucent and opaque sections.

The relative sizes of the translucent section 37 relative to the opaque section 38 may vary. The translucent section 37 may extend around various amounts of the lateral wall 33 within a range of between about 30°-180°. The opaque section 38 extends around the remaining portion of the lateral wall 33. FIG. 4 includes an embodiment with the translucent section 37 extending around about one-quarter of a total length of the lateral wall 33 with the opaque section 37 extending the remaining three-quarters of the length (i.e., the translucent section 37 extends through an arc of about 90° with the opaque section 38 extending through the remaining 270°). In one embodiment, the translucent section 37 extends around less than or equal to one-half of the total length of the lateral wall 33. FIG. 6 illustrates a housing 32 with a triangular cross-sectional shape. The translucent section 37 extends across one of the faces (i.e., along one-third of the length of the lateral wall 33) with the opaque section 38 at the remaining two faces.

The opaque section 38 may be constructed in a variety of different manners. The material itself that forms the housing 32 at the opaque section may be constructed to block the light. Another embodiment includes an opaque screen 39 positioned in proximity to the housing 32 to form the opaque section 38. The screen 39 may be positioned on the inner or outer sides of the opaque section 38. FIG. 6 illustrates an opaque section 38 formed by first and second screens 39 that extends across the sides of the lateral wall 33. The screen 39 may be spaced away from or in contact with the housing 32. In one embodiment, the screen is a coating applied to the inner and/or outer sides of the housing 32 at the opaque section 38. The various manners of providing the opaque section 38 may be used alone (e.g., just a screen) or in combination (e.g., a screen in combination with an opaque housing 32).

The axial wall 34 of the housing 32 is translucent to allow light to be emitted in the axial direction towards the head 22. The axial end 33 may include the same or different material as the lateral wall 33. In one embodiment, the housing 32 is constructed as a single integral piece with a one-piece construction. Other embodiments include the axial end 33 being a separate piece from the lateral wall 33. The lateral wall 33 itself may be constructed from one or more separate portions. The various portions and/or the axial wall 34 may be connected together by various means, such as adhesive, mechanical fasteners, and ultrasonic welding.

The light 30 may further include one or more reflective surfaces. The reflective surfaces may be positioned along the opaque section 38 and along the axial end of the handle 21.

As illustrated in FIG. 4, the housing 32 may also include one or more positioners 51 to engage with the sleeve 40. The positioners 51 may extend outward from or be recessed within the lateral wall 33.

The sleeve 40 extends around the lateral wall 32 and is opaque to block the light when positioned across the translucent section 37. The sleeve 40 is movable relative to the housing 32 to be selectively positioned between the open orientation away from at least a portion of the translucent section 37 to allow light to be emitted in lateral directions, and a closed orientation across the translucent section 37 to block the light as illustrated in FIG. 3.

Figure 7:
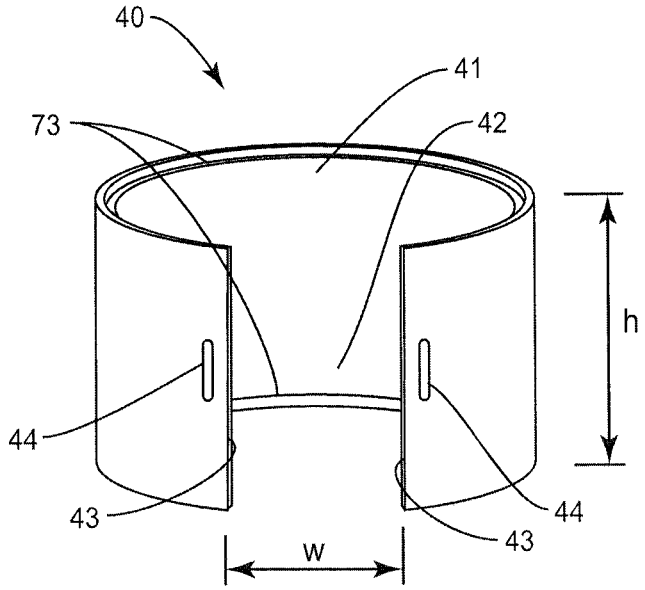
FIG. 7 is a perspective view of a sleeve.

The sleeve 40 may remain attached to the razor 10 when moving between the open and closed orientations. FIG. 7 illustrates a sleeve 40 that remains attached to the razor 10. The sleeve 40 includes a body 41 with a curved shape and opposing ends 43. The ends 43 are spaced apart to form a light-emitting section 42. The body 41 is opaque to block the light from being emitted laterally from the housing when the body 41 is positioned over the translucent section 37 of the housing 30. As with the housing 30, the body 41 may be constructed from an opaque material, or may include a layer of opaque material.

The body 41 includes a cross-sectional shape that substantially matches that of the housing 32. This provides for the sleeve 40 to be moved around the housing 32. FIG. 6 includes the sleeve 40 having a substantially circular cross-sectional shape that matches that of the housing 32.

The width w of the light-emitting section 42 may vary. In one embodiment, the width w is substantially the same as that of the translucent section 37. This provides for the opening 42 to be precisely aligned with the translucent section 37. Other embodiments may include the width w being larger or smaller than the translucent section 37. The axial height h may also substantially match that of the housing 32. This prevents any unintentional light from being laterally emitted when the sleeve 40 is in the closed orientation. Other embodiments include the height h being larger than that of the housing 32.

The sleeve 40 also includes one or more positioners 44 that engage with the corresponding positioners 51 of the housing 30. The positioners 44 may extend outward from or be recessed within the body 41. The positioners 44, 51 engage when the sleeve 40 is in the open orientation to provide a tactile and/or audible input to the user to indicate this position.

Figure 8:
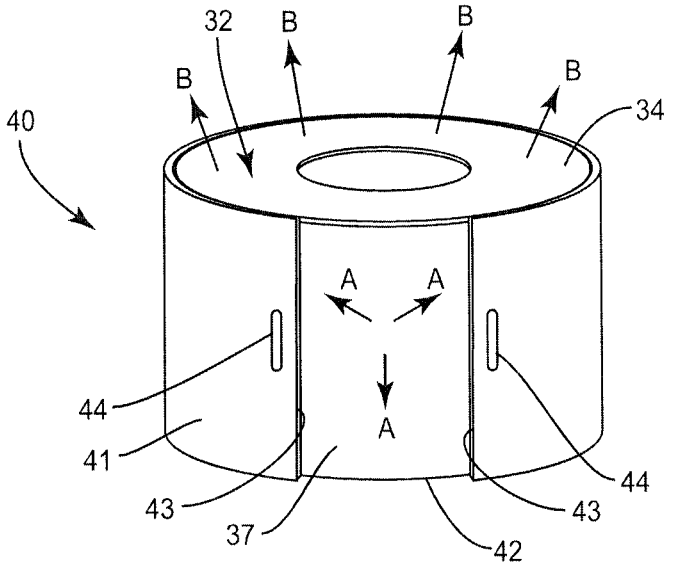
FIG. 8 is a perspective view of a sleeve in an open orientation relative to a housing.

FIG. 8 illustrates the sleeve 40 in the open orientation relative to the housing 32. For purposes of clarification, the body 20 and one or more light elements 31 are not included. The sleeve 40 is positioned with the light emitting section 42 of the sleeve 40 aligned with the translucent section 37 of the housing 32. In this embodiment, the ends 43 of the sleeve 40 are substantially aligned with the ends of the translucent section 37. Other embodiments may include the ends 43 positioned over and extending into the translucent section 37, and spaced away from the ends and away from the translucent section 37. This orientation provides for light to be emitted laterally as illustrated by arrows A. Further, the positioners 44 are engaged with the positioners 51 (not illustrated). As further illustrated, light is also emitted through the axial wall 34.

Figure 9:
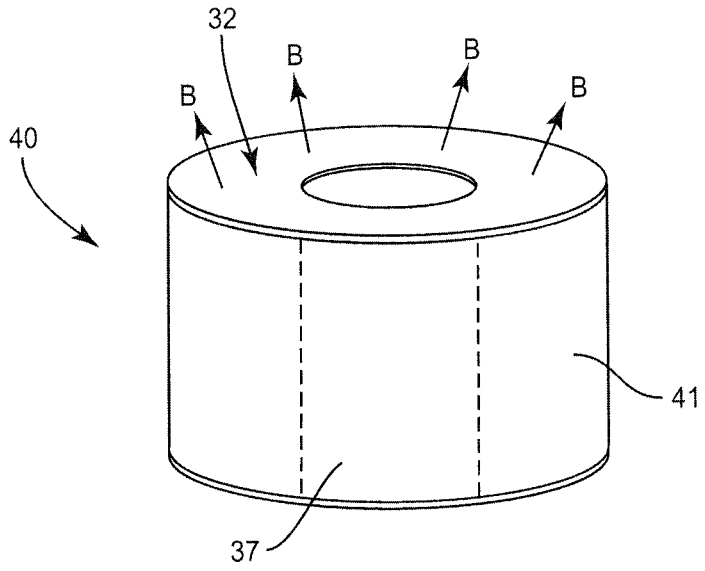
FIG. 9 is a perspective view of a sleeve in a closed orientation relative to a housing.

To move the sleeve 40 to the closed orientation, the user applies a force to the body 41 to rotate the sleeve 40 relative to the housing 32. FIG. 9 illustrates the sleeve 40 in a closed orientation. The opaque body 41 extends across the translucent section 37 of the housing 32. This prevents light from being laterally emitted from the housing 32. The light emitting section 42 of the sleeve 40 is positioned away from the translucent section 37 and aligned with the opaque section 38. FIG. 9 includes the light emitting section 42 being positioned on an opposing side of the housing 32 from the translucent section 37 (and thus not visible in FIG. 9). The closed orientation may also include other relative positions in which the light emitting section 42 is positioned away from the translucent section 37.

Figure 10:
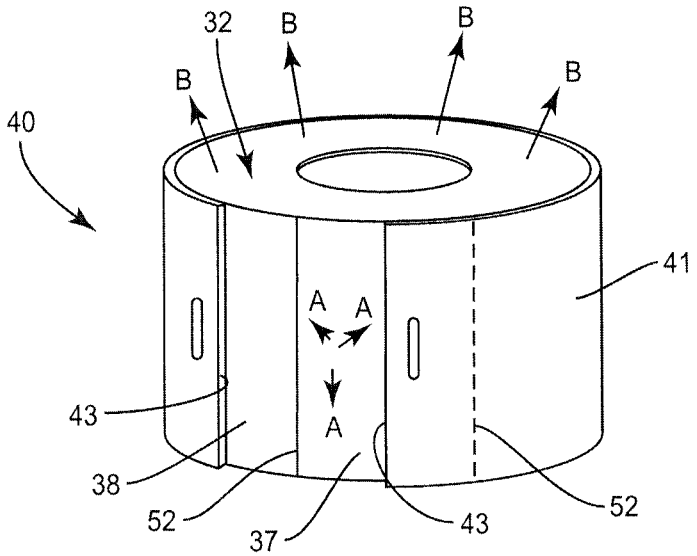
FIG. 10 is a perspective view of a sleeve in an open orientation relative to a housing.

FIG. 8 includes the sleeve 40 positioned in an open orientation with the body 41 of the sleeve 40 away from the translucent section 37. The sleeve 40 may also be positioned at various other relative positions in which portions of the light emitting section 42 are aligned with the translucent section 37. FIG. 10 includes the sleeve 40 in the open orientation and partially covering the translucent section 37. The translucent section 37 is formed between ends 52. The sleeve 40 is positioned such that a portion of the opaque body 41 is extending over the translucent section 37. Light is laterally emitted through the exposed portion of the translucent section 37. This adjustability provides for the user to position the sleeve 40 relative to the housing 32 to adjust an amount of light that is laterally emitted. As is apparent, the amount of light laterally emitted from the housing 32 is dependent upon the amount of exposed translucent section 37.

Figure 11:
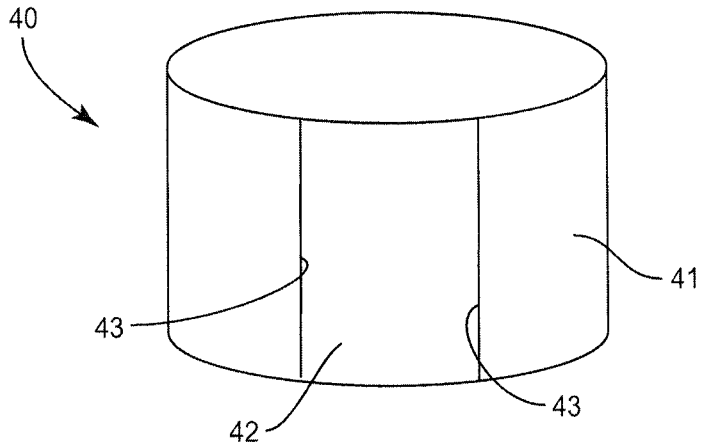
FIG. 11 is a perspective view of a sleeve.

FIG. 11 includes a sleeve 40 with a single, one-piece continuous body 41. The body 41 includes a translucent light emitting section 42 formed between ends 43, and an opaque remainder. The sleeve 40 is movable relative to the housing 32 to adjust the position of the light emitting section 42 to adjust an amount of lateral light emitted from the housing 32. In one embodiment, the body 41 is constructed from a translucent material with the portion away from the light emitting section 42 being covered by an opaque material.

Figure 12:
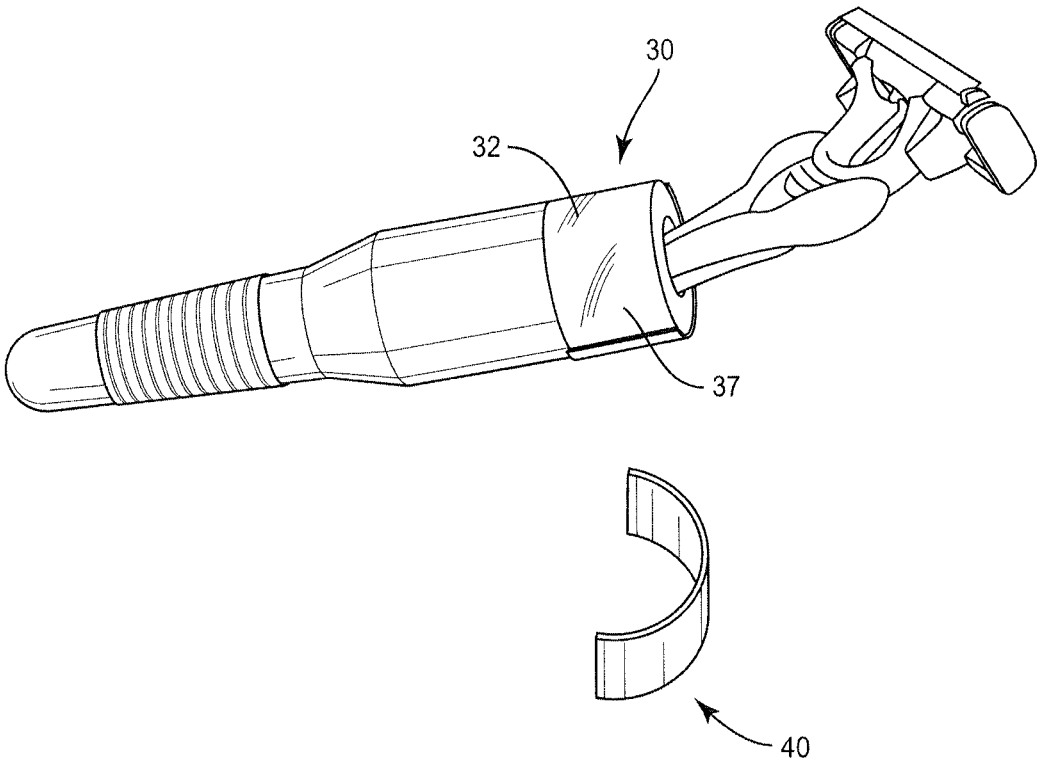
FIG. 12 is a perspective view of a razor in an open position with a sleeve removed from a housing.

The sleeve 40 may also be removably attached to the housing 32. FIG. 12 includes the sleeve 40 that is sized to extend across the translucent section 37 in the closed orientation. The open orientation includes the sleeve 40 being removed from the housing 32 such that the entirety of the translucent section 37 is exposed.

The sleeve may be attached to the razor 10 in a variety of manners. In one embodiment, the body 41 of the sleeve 40 is constructed of a flexible material. The body 41 can be flexed to extend over the housing 32 and released to apply a compressive force to maintain the connection. The sleeve 40 and housing 30 and/or handle 21 may include corresponding tabs and detents. The tabs and detents connect together when the sleeve 40 is attached to the razor 10.

In another embodiment as illustrated in FIGS. 4 and 7, the inner side of the edge of the sleeve 40 includes one or more outwardly-extending rails 73 and the outer side of the lateral wall 33 of the housing 32 includes one or more grooves 74. The rails 73 are sized to fit into the grooves 74 to maintain the sleeve 40 attached to the housing 32. The rails 73 and grooves 74 are also configured to allow the sleeve 40 to slide around the housing 32 to adjust an amount of light that is emitted through the translucent section 37. The ends of the rails 73 may further include lips that are angled relative to the remainder of the rails 73 and fit into corresponding indents in the grooves 74 to better attach the sleeve 40. The orientation of the rails 73 and grooves 74 may also be reversed, with the lateral wall 33 of the housing 32 including rails 73 and the sleeve 40 including grooves 74

The rails 73 and grooves 74 may be positioned at various locations along the elements. FIGS. 4 and 7 illustrate a placement inward from the axial ends of the elements. Other embodiments include the rails 73 and grooves 74 positioned at one or both axial ends. In embodiments with multiple rails/grooves, the rails and grooves may have the same or different shapes and/or sizes.

The head 22 may be connected to the body 21 through a neck 28. In another embodiment, the body 20 does not include a neck 28 with the head 22 being connected directly to the light 30.

In some embodiments, the housing 32 includes an axial wall 34 that faces towards the head 22 and blade 23. In other embodiments, the housing 32 does not include the axial wall 34. The axial end is open beyond the lateral wall 33.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A razor comprising:

a body with a handle and a blade, the handle including an elongated shape with a longitudinal axis;

at least one light element associated with the handle that emits light, the at least one light element being configured to emit the light in an axial direction along the longitudinal axis and a lateral direction perpendicular to the longitudinal axis;

a housing positioned at the end of the body that extends over and encloses the at least one light element and includes a lateral wall with a light emitting portion that extends along a first portion of the lateral wall with a remainder of the lateral wall being opaque, the housing also including a light emitting axial end wall that extends across the longitudinal axis; and a sleeve comprising an opaque body with a pair of spaced-apart end walls that are separated by a gap, the sleeve being operatively connected to the housing, the sleeve being positionable between a first orientation with the opaque body positioned across the light emitting portion of the lateral wall to prevent the light from being emitted in the lateral direction with just the light through the axial end wall being emitted from the handle, and a second orientation with the gap positioned at the light emitting portion for the light to be emitted from the handle through both the light emitting portion of the lateral wall and the light emitting axial end wall;

the sleeve being positioned away from the light emitting axial end wall of the housing with the light being emitted from the handle and onto the blade in each of the first and second orientations.

2. The razor of claim 1, wherein the at least one light element and the housing are positioned axially along the longitudinal axis between the handle and the blade with the light emitted in the axial direction shining on the blade.

3. The razor of claim 2, further comprising a neck that extends between and connects the handle and the blade with the housing further including an opening through which the neck extends.

4. The razor of claim 2, wherein the axial end wall of the housing is translucent.

5. The razor of claim 1, wherein the lateral wall of the housing is continuous and the light emitting portion includes a translucent material, the light emitting portion having a length that is less than or equal to one half of a total length of the housing.

6. The razor of claim 1, wherein the housing and the sleeve each have a circular cross-sectional shape for the sleeve to rotate around the housing.

7. A razor comprising:

a body with a handle and a blade, the blade facing in a first lateral direction;

a housing positioned at an end of the handle, the housing including a lateral wall with a first light emitting portion that faces in the first lateral direction and an opaque portion that faces in an opposing second lateral direction, the housing also including an axial end wall with a second light emitting portion that faces in an axial direction towards the blade and transverse to the first and second lateral directions;

at least one light element positioned in the housing and configured to emit light in the first lateral direction and in the axial direction perpendicular to the first lateral direction; and a sleeve comprising an opaque body with a pair of spaced-apart end walls that are separated by a gap, the sleeve positioned at the housing and being movable relative to the housing between a first orientation with the opaque body positioned across the first light emitting portion of the lateral wall to prevent the light from being emitted beyond the sleeve in the first lateral direction and to be emitted in just the axial direction onto the blade, and a second orientation with the opaque body positioned away from the first light emitting portion of the lateral wall and the gap positioned at the first light emitting portion of the lateral wall for the light to be emitted in the first lateral direction and the axial direction;

the sleeve positionable between the first and second orientations to control the amount of light emitted in the first lateral direction without affecting the amount of light emitted in the axial direction onto the blade.

8. The razor of claim 7, wherein the axial end wall of the housing is translucent.

9. The razor of claim 7, wherein the axial end wall and the lateral wall include a one-piece unitary construction with the axial end wall and the first light emitting portion each being constructed from a translucent material.

10. The razor of claim 7, wherein the opaque portion of the lateral wall extends at least one-half of a length of the lateral wall.

11. The razor of claim 7, wherein each of the housing and the sleeve include a substantially circular cross-sectional shape for the sleeve to rotate around the housing.

12. The razor of claim 7, wherein the opaque body of the sleeve is a C-shaped with the gap positioned between opposing end walls.

* * * * *